United States Patent [19]

Barnes et al.

[11] 4,279,419

[45] Jul. 21, 1981

[54] TABLE TOP GOLFING FIGURE WITH SPRING DRIVING ROTATABLE UPPER TORSO

[75] Inventors: George A. Barnes, Seattle; Leslie Perhacs, Jr., Port Ludlow, both of Wash.

[73] Assignee: Victory Games, Inc., Issaquah, Wash.

[21] Appl. No.: 170,648

[22] Filed: Jul. 21, 1980

[51] Int. Cl.[3] ..... A63F 7/06

[52] U.S. Cl. ..... 273/87.4; 46/173

[58] Field of Search ..... 273/87.4, 77 R, 85 A, 273/85 B, 129 V, 89, 87.2; 46/119, 173

[56] References Cited

U.S. PATENT DOCUMENTS

| | | | |
|---|---|---|---|
| 1,552,536 | 9/1925 | Blevins et al. | 273/87.4 |
| 1,618,638 | 2/1927 | Coles | 273/77 R |
| 3,050,307 | 8/1962 | Glass et al. | 273/87.4 |
| 3,054,615 | 9/1962 | Budish | 273/87.4 |
| 3,458,195 | 7/1969 | Neubeck | 273/87.4 |
| 3,928,932 | 12/1975 | Maurer | 273/87.4 X |
| 4,239,217 | 12/1980 | Thieme et al. | 273/87.4 |

OTHER PUBLICATIONS

"Lil Pro", Sports Forreal Inc., Osseo, Minn. 55369.

*Primary Examiner*—George J. Marlo
*Attorney, Agent, or Firm*—Graybeal & Uhlir

[57] ABSTRACT

A golfing figure is shaped to resemble the stance of a human golfer when addressing a golf ball and is designed to duplicate an ideal golf swing. The golfing figure includes an upper body member which is joined with a lower body member to rotate about an axis extending generally along the length of the upper body member in the same manner in which the upper body of a golfer swings when hitting a ball. The upper and lower body members are interconnected by a torsion spring which automatically rotates the upper body member forwardly after it has been manually rearwardly rotated. The degree of relative rotation permissible between the upper and lower body members is limited to approximately the actual movement of the upper body of a golfer when hitting a golf ball. The torsion spring is mounted within mating upper and lower sockets contained at the juncture of the upper and lower body members. The hands of the golfing figure include an arcuate notch which is adapted to receive and lock a blade projection on the handle end of a miniature golf club held by the golfing figure.

11 Claims, 10 Drawing Figures

TABLE TOP GOLFING FIGURE WITH SPRING DRIVING ROTATABLE UPPER TORSO

FIELD OF THE INVENTION

The present invention relates to games, and in particular to a new golfing figure adapted to propel a miniature golf ball.

DESCRIPTION OF THE PRIOR ART

Many different sports, such as baseball, football and hockey have been successfully transformed into table games. In general, the games attempt to simulate the "action" of the sports. This is in part accomplished by providing playing figures which in configuration and movement, resemble actual baseball, football or hockey players which are used in conjunction with a field or rink of a scale corresponding to the scale of the playing figure. Moreover, realism is attained by incorporating into the games as many of the actual rules of the sport as possible, for instance, in a baseball game, after three strikes the batter is out.

in addition to providing entertainment, many of the miniaturized sports games can be used as a vehicle for teaching not only the rules of a sport, but also possible strategies, such as different offensive and defensive formations in football. Moreover, typically the playing figures are designed to mechanically duplicate the movement of actual players so that playing technique can also be taught.

In addition to the particular games mentioned above, various golf table games have also been in existence. However, the realism in known golf table games has paled in comparison to other sports games such as baseball, football and hockey. This lack of realism has been at least in part due to the design of the golfing figures. In one known type of golfing game, the playing figure includes a leg portion having pegs extending downwardly from the bottom of the legs to engage within holes provided in the game board. The playing figure also includes an upper body portion having a longitudinal bore extending therethrough for engaging over a shank which extends upwardly from the leg portion to thereby enable the upper body portion to rotate relative to the leg portion of the playing figure. The upper or free end of the shank is fitted with a simulated head. The upper body portion includes depending arms to which the shaft of a golf club is attached. To strike a ball, the upper body portion is manually twisted to thereby swing the golf club so that it strikes the ball. A drawback of this particular type of golfing figure is that by requiring the golfing figure to be twisted manually, the ball cannot be hit hard enough to cause the ball to travel a distance corresponding to the size of the golfing figure. Moreover, if the upper body portion of the golfing figure is twisted very rapidly, the golf club will tend to disengage from the golfer's arms.

In another type of golf game, the golfing figure includes a pair of legs affixed to a relatively large surface which serves as a tee. An upper body portion of the golfer is connected to the legs through the use of a relatively thin, rubber center section sandwiched between the lower end of the upper body and the upper end of the legs to thereby enable the upper body section to pivot relative to the legs. The shaft of a golf club is engageable within a socket formed in the arms of the upper body portion. One drawback of this particular design is that the resilient rubber joint makes it difficult for the upper body portion to rotate through the entire angle which an actual golfer's upper body rotates when using a longer distance club, such as wood.

A further known type of golfing figure is composed of a pair of legs and an upper body portion which are constructed from pieces of solid plastic material. The upper body portion is adapted to pivot relative to the pair of legs. To this end, a socket is formed in the upper portion of the legs and in the lower portion of the upper body to each receive a cup-shaped insert. The two inserts are rotatably interconnected by a torsion spring so that when the upper body portion is rotated rearwardly and then released, it automatically rotates forwardly to swing a golf club. Although the torsion spring accelerates the upper body portion in the manner similar to the motion of the upper body of an actual golfer, no stops or other devices are utilized to limit the relative rotation between the two body portions. As a consequence, if substantial care is not taken, the torsion spring can be overstressed from being wound too tightly. Moreover, it is possible for the upper body portion to be twisted too far forwardly to thus unwind the torsion springs, also leading to its failure.

Thus, it is a principal object of the present invention to provide a golfing figure having an upper body member rotatably connected to a pair of legs by a spring member capable of rotating the two body members relative to each other through an angle of rotation limited to the angle which the upper and lower body portions of a human golfer rotate when swinging a golf club.

SUMMARY OF THE INVENTION

The present invention relates to a novel golfing figure shaped to resemble an actual golfer addressing a golf ball with a club. The golfing figure, in basic form, is characterized by an upper body member forming the portion of the golfing figure from the waist up and a lower body member forming the portion of the golfing figure from the waist down. The upper body member is joined to the lower body member by a joint assembly which enables the two body members to rotate about an axis extending generally along the length of the upper body member to thereby closely simulate the swing of an actual golfer. The joint assembly includes a pin which extends downwardly through a downwardly open upper socket formed in the lower portion of the upper body member to closely, rotatably engage within a pilot hole formed in the bottom of an upwardly open socket formed in the upper portion of the lower body member. The upper and lower body members are interconnected by opposite ends of a torsion spring which is housed within the body member sockets and engaged over the pin. When the upper body member is rotated rearwardly and released, the spring rotates the upper body member forwardly to thereby swing a golf club held by the arms of the upper body member in a manner similar to the swing of an actual golfer.

The upper body member is permitted to rotate through an angle generally corresponding to the actual angle of rotation of the upper body of a human golfer when striking the golf ball. The angle of rotation of the upper body member is limited by a lug member which extends downwardly from the upper body member to sweep through an arcuate groove formed in the lower socket. The groove extends partially around the pilot hole formed in the lower socket, with the radius of the arcuate groove corresponding to the radius of the partial circle swept by the lug member. The groove includes end walls which are abuttable against the lug member to thereby limit the rearward and forward rotation of the upper body member so that the torsion spring cannot be wound up so tightly that it is overstressed nor unwound to the extent that the coils of the spring are permanently deformed.

The hands of the golfing figure are clasped together in the manner commonly used to grip a golf club. An opening is formed in the hands to longitudinally, slidably receive the handle portion of the golf club. To prevent the golf club from becoming disengaged from the hands, an arcuate blade member, which partially encircles the golf club handle, is snugly receivable within an arcuate notch formed in the hands of the golfer. Once the club handle has been engaged with the opening formed in the hands, the club is simply rotated to engage the blade into the notch formed in the hands of the golfer.

It is a principal object of the present invention to provide a miniature golfing figure constructed with a rotatable upper torso to simulate the movement of an actual golfer when swinging a golf club.

A further object of the present invention is to provide a miniature golfing figure having a rotatable upper torso which is constructed to rotate through an angle approximating the angle of rotation of the upper body of an actual golfer when hitting a golf ball.

Another object of the present invention is to provide a miniature golfer which can be selectively positioned relative to the golf balls to strike the ball at various angles to thereby impart different types of spin on the ball.

One more object of the present invention is to provide a miniature golfing figure having hands configured so that the handle of a golf club can be securely locked to the hands and also quickly removed from the hands and replaced by another club.

An additional object of the present invention is to provide a golfing figure which is not only rugged enough to withstand repeated and rough usage, but also which can be economically manufactured and assembled.

DETAILED DESCRIPTION OF PREFERRED EMBODIMENT

Figure 1:
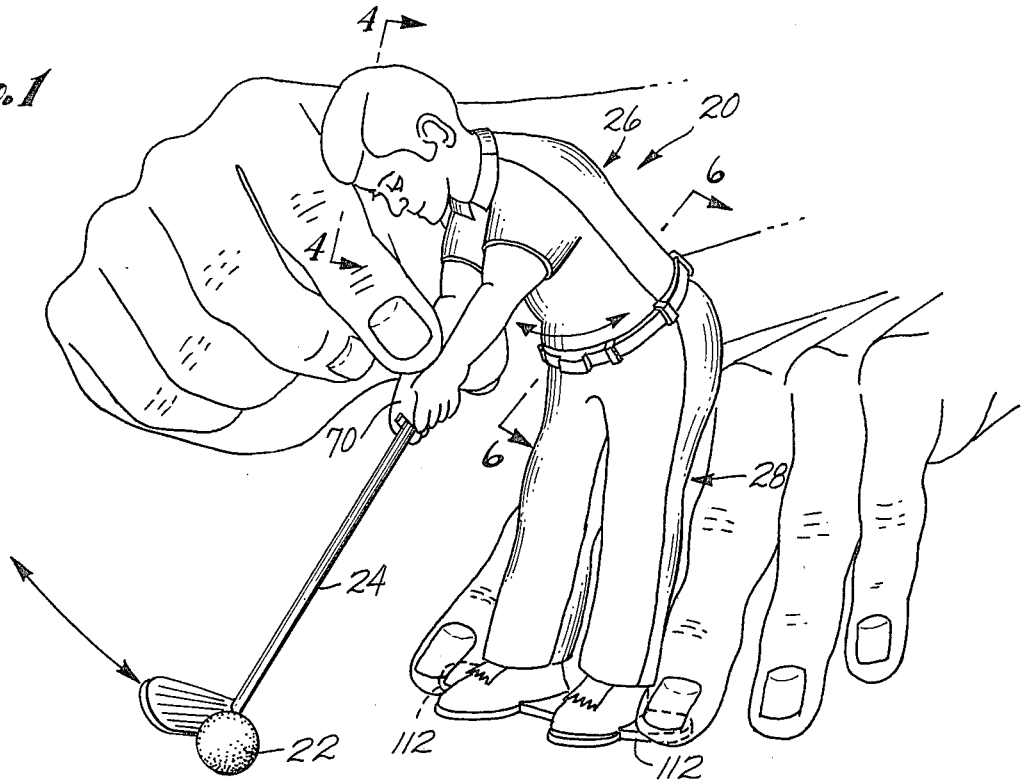
FIG. 1 is an isometric view of a typical golfing figure constructed according to the present invention looking toward the front of the left shoulder of the figure and illustrating the figure in operation with one hand of the user holding the legs of the figure stationary while the other hand rotates the upper body member rearwardly.
Figure 2:
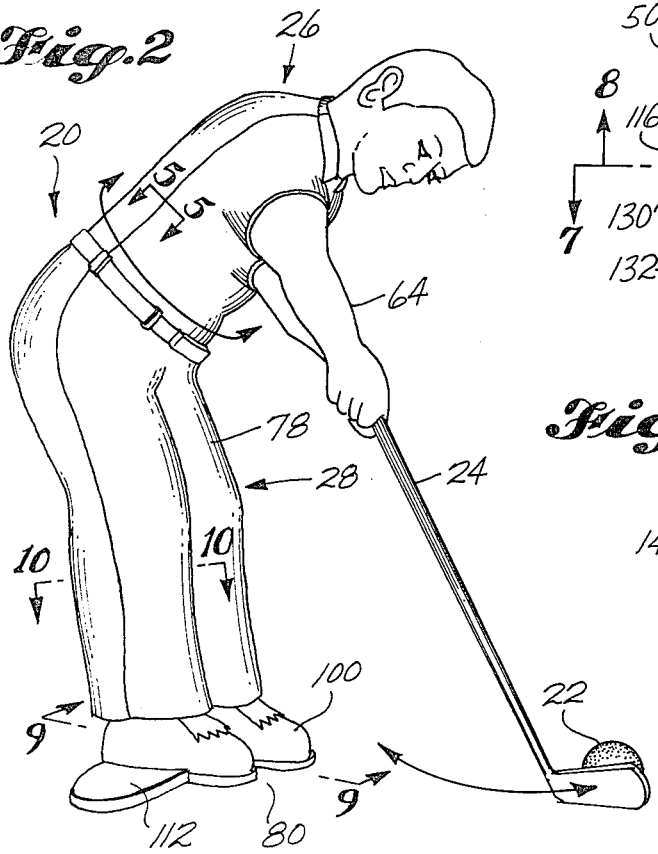
FIG. 2 is a perspective view of the typical golfing figure illustrated in FIG. 1 looking upwardly toward the right side of the golfing figure.

Referring initially to FIGS. 1–2, a miniature golfing figure 20, shaped to resemble a human golfer, is illustrated as bent forwardly at the hips and facing a golf ball 22 in the same manner in which a human golfer typically addresses the ball while striking it with a golf club. The arms of the golfing figure are outstretched and its hands clasped together to grip the handle portion of a golf club 24 in the traditional manner. Additionally referring to FIGS. 6–8, golfing figure 20 is basically composed of an upper body member 26 rotatably interconnected with a lower body member 28 by a spring-loaded joint assembly 30. By this construction, the upper body member 26 can be manually rotated rearwardly to simulate a back swing and then released, whereupon the upper body member automatically rotates forwardly, swinging club 24 to hit ball 22 in the same way in which an actual golfer would hit a golf ball.

Figures 3, 4, 5, 8, 9, 10:
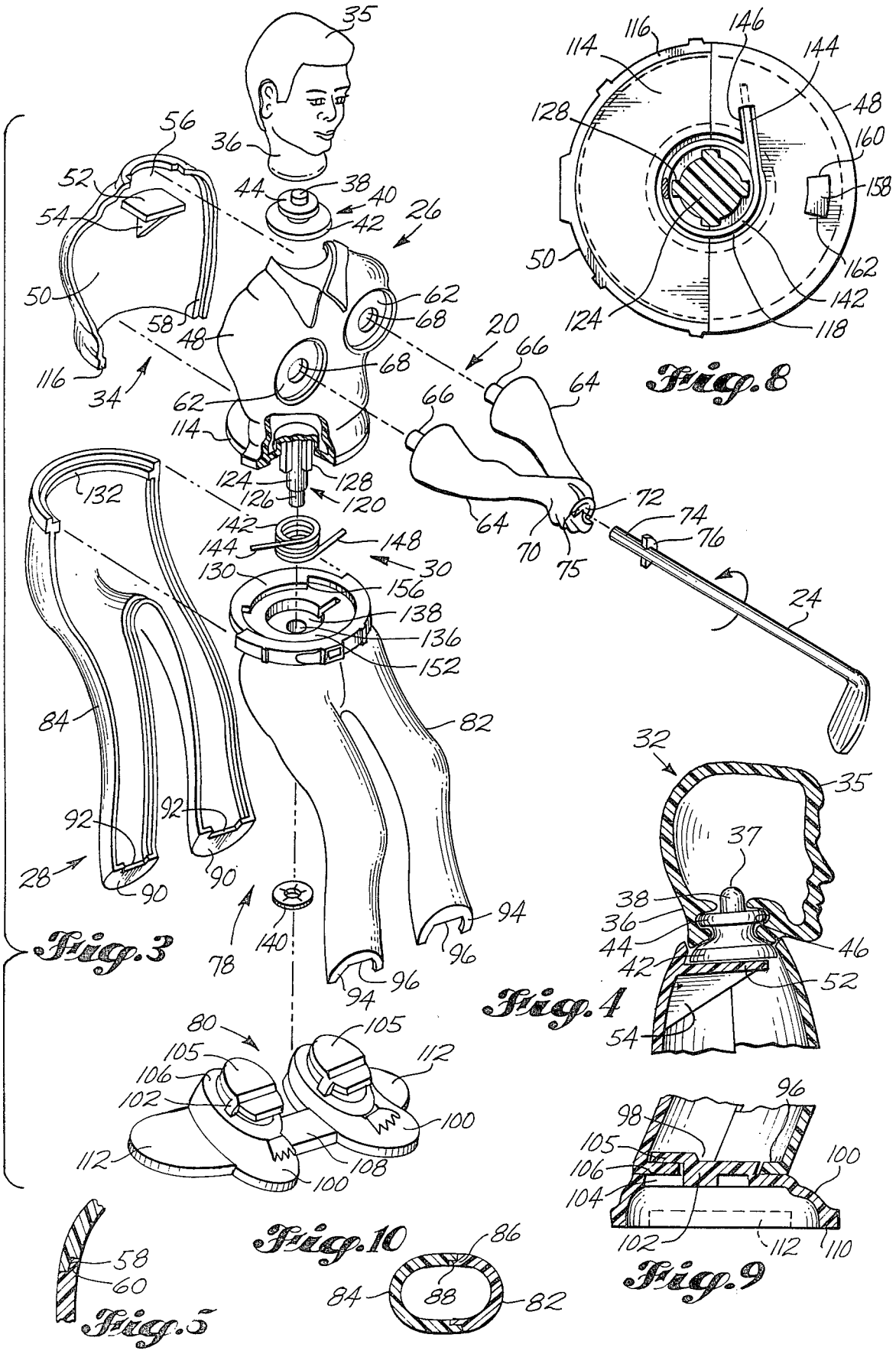
FIG. 3 is an exploded, front isometric view of the typical golfing figure shown in FIGS. 1 and 2 specifically illustrating the components composing the golfing figure.
FIG. 4 is an enlarged, fragmentary cross-sectional view of the typical golfing figure illustrated in FIG. 1, taken substantially along lines 4—4 thereof, specifically depicting the manner in which the head and chest assembles are interconnected.
FIG. 5 is a fragmentary cross-sectional view of a portion of the typical golfing figure illustrated in FIG. 2, taken substantially along lines 5—5 thereof specifically illustrating the manner in which front and rear chest halves are joined together.
FIG. 8 is a cross-sectional view of the portion of the typical golfing figure illustrated in FIG. 6, taken substantially along lines 8—8 thereof, and specifically illustrating the construction of the upper body member socket.
FIG. 9 is an enlarged cross-sectional view of a portion of the typical golfing figure illustrated in FIG. 2 as taken substantially along lines 9—9 thereof and particularly showing the interconnection of the golfing figure's legs and feet.
FIG. 10 is an enlarged, fragmentary cross-sectional view of a portion of the typical golfing figure illustrated in FIG. 2, detailing the manner in which the front and rear leg halves are joined together.

Upper body member 26, as best shown in FIGS. 3 and 4, includes a head assembly 32 mounted on the upper end of a chest assembly 34. Head assembly 32 includes a hollow head section 35 and an integral, hollow neck section 36, both shaped to resemble a human head and neck. An opening 37 is formed through neck section 36 and the adjacent portion of head section 35 for receiving the post 38 of a joiner member 40 which interconnects neck section 36 with chest assembly 34. Joiner member 40 also includes a generally flat, circular base 42 from which post 38 extends upwardly, and a ridge 44 which extends circularly around post 38 to fit snugly within a correspondingly shaped groove 46 formed in hole 37. Ridge 44 and groove 46 cooperate to retain post 38 engaged within hole 37 while permitting head section 35 to rotate relative to chest assembly 34.

Still referring primarily to FIGS. 3 and 4, chest assembly 34 is hollow in form and composed of a front chest half 48 and a rear chest half 50 fixedly assembled together to resemble a human chest. Both front and rear chest halves 48 and 50, respectively, are formed from thin material, preferably some type of readily moldable plastic material. A flat shelf 52 cantilevers forwardly from the inside surface of rear chest half 50 to support base 42 of joiner member 40. Shelf 52 is reinforced by a triangularly shaped gusset plate 54 which extends along the underside of the shelf and the inside surface of rear chest half 50, FIG. 4. Front and rear chest halves 48 and 50 together define a circular neck opening 56 of a diameter smaller than the diameter of base 42 to surround the post portion 38 of joiner member 40 to thereby retain base 42 between shelf 52 and neck opening 56.

As illustrated in FIG. 5, to facilitate the assembly of chest assembly 34, the vertical or side edge portions of rear chest half 50 are notched along the inside surface of the chest half at 58 to receive a correspondingly shaped lip 60 formed along the side edges of front chest half 48. Notch 58 and lip 60 cooperate together to positively locate the front and rear chest halves 48 and 50 relative to each other. Chest halves 48 and 50 can be secured together by any convenient means, such as by gluing or ultrasonic weldments.

Referring specifically to FIG. 3, front chest half 48 includes a pair of circularly shaped, shallow depressions 62 for receiving the generally circular end portions of arms 64. A circular stud 66 extends longitudinally outwardly from the end of each arm 64 to extend through a correspondingly shaped hole formed in the flat, base portion of each depression 62. Once arms 64 are assembled with front chest half 48, the portions of studs 66 extending through hole 68 can be deformed and enlarged to thereby securely lock the arms in place. Alternatively the ends of arms 64 can be glued or ultrasonically welded to the base portion of depressions 62.

Next referring to FIGS. 1 and 3, the hands 70 of the golfing figure are clasped together in the traditional manner for gripping a golf club. A circular bore 72 is formed in hands 70 to slidably receive the handle 74 of golf club 24. An arcuate notch 75 is formed in hands 70 to extend part way around the circumference of bore 72. A semicircularly shaped blade 76, which partially surrounds the circumference of golf club handle 74, is sized to snugly engage within notch 75 once handle 74 has been longitudinally slid into bore 72. It will be appreciated that this construction enables golf club 24 to be not only quickly and securely locked with hand 70, but also conveniently removed and replaced with another club, not shown.

Golfing figure 20 also includes a lower body member 28 composed generally of a leg assembly 78 interconnected with a foot assembly 80. Leg assembly 78 includes a front leg half 82 and a rear leg half 84 which are joined together along their respective side edges extending along the inside and outside portions of each of the two legs. As most clearly shown in FIG. 10, the edge portions of rear leg half 84 are notched along their inside surface at 86 to receive a correspondingly shaped lip 88 extending along the side edge portions of front leg half 82. By this construction, the leg halves 82 and 84 are positively located relative to each other.

The bottom of each leg of rear leg half 84 is substantially closed off by an end plate 90 having a rectangularly shaped notch 92 formed therein. The lower ends of front leg half 82 are not closed off to the extent of rear leg half 84, rather an inwardly directed rim 94 extends around the inside perimeter of the lower edge of the two legs of front leg half 82. Rim 94 has a central, straight portion 96 extending a distance transversely across each of the two legs. Central rim portion 96, as best shown in FIGS. 3 and 9, is slanted diagonally downwardly and rearwardly to abut against a correspondingly shaped front edge of a stepped plate 98 which is supported at an elevation above hollow shoes 100 of feet assembly 80 by a transversely extending riser 102 which spans across the upper opening 104 of each shoe 100. Also as most clearly illustrated in FIG. 9, end plates 90 of rear leg half 84 are sandwiched between the underside of the rear portion 105 of each stepped plate 98 and the upper edge 106 of a corresponding shoe 100. It will be recognized that by this construction feet assembly 80 is securely attached to leg assembly 78 and without requiring the use of any hardware fasteners, such as screws.

Still referring to FIGS. 9 and 10, shoes 100 are of hollow construction and are shaped similarly to traditional golfing shoes. Shoes 100 are interconnected by a central plate 108 having a bottom surface disposed coplanar with the flat lower rim 110 of the shoes 100. An arcuately shaped end plate 112 extends transversely outwardly from the side of each shoe 100 to provide a bearing surface for the fingers of the person playing with the golfing figure, FIG. 1.

Next referring specifically to FIGS. 3 and 6–8, a joint assembly 30, interconnecting upper and lower body members 26 and 28, respectively, includes portions which are integrally formed with the two body members. The joint assembly includes a flat, annularly shaped upper flange 114 integrally formed with the lower edge portion of front chest half 48. Flange 114 extends generally transversely to the length of upper body member 26, with the front circumferential half of the flange interconnected with front chest half 48. The rear circumferential half of flange 114 extends rearwardly from front chest half 48 to intersect with the lower edge portion of rear chest half 50. To his end, a thin lip 116 is formed around the perimeter of the lower edge portion of rear chest half 50 to abut against the rearwardly extending portion of flange 114, which rearward portion is reduced in diameter to accommodate lip 116.

Figure 6:
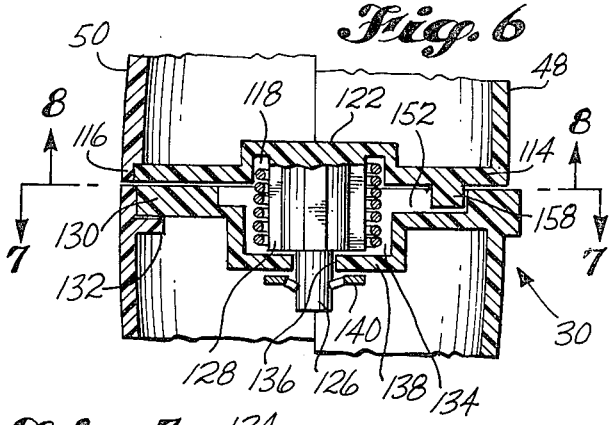
FIG. 6 is an enlarged cross-sectional view of the typical golfing figure illustrated in FIG. 1 taken substantially along lines 6—6 thereof specifically illustrating the manner in which the upper and lower body members are interconnected.

As most clearly shown in FIGS. 3 and 6, a downwardly open socket 118 extends upwardly from the central portion of upper flange 114. Socket 118 is circular in cross section and preferably integrally formed with flange 114. A stepped diameter stud 120 extends downwardly from the center of a circularly shaped base 122 of socket 118 to an elevation below upper flange 114. Stud 120 includes a larger diameter upper or base portion 124 located adjacent socket base 122 and a smaller diameter free or lower end portion 126 located distal to socket base 122. Stud 120 also includes a plurality of flanges 128 which extend radially outwardly from stud base portion 124 to increase the effective diameter of the stud.

Joint assembly 30 further includes a lower, annularly shaped flange 130 integrally formed with, and extending generally transversely to, front leg half 82. The outer circumference of flange 130 also forms the outer periphery of front leg half 82. The portion of flange 130 extending rearwardly from front leg half 82 is reduced in diameter to mate with the inside surface of the upper edge portion of rear leg half 84, FIGS. 6 and 7. A narrow, inwardly extending ledge 132 extends around the inside surface of rear leg half 84 to underlie and support the adjacent portion of lower flange 130. It will be recognized that when front and rear leg halves 82 and 84 are joined together, the two leg halves and lower flange 130 cooperate together to form an integral, hollow structure.

A lower socket 134 of circular cross section extends downwardly from lower flange 130. Socket 134 has an inside diameter corresponding to the inside diameter of upper socket 118. A pilot hole 136 is centrally formed in the circular base portion 138 of lower socket 134 to closely and rotatably receive the smaller diameter, free end portion 126 of stud 120. As best shown in FIG. 6, the larger diameter portion 124 of stud 120 bottoms on the upper surface of socket base 138 to thereby space upper flange 114 slightly above lower flange 130. Stud 120 is retained within pilot hole 136 by a snap ring 140 which frictionally anchors around the outer circumference of the portion of stud end 126 extending below socket base 138. It will be appreciated that because of their relative difference in bearing surface area, bottoming the larger diameter portion 124 of stud 120 on socket base 138 generates a significantly smaller frictional drag upon rotation of upper body member 26 relative to the lower body member 28, as opposed to if upper flange 114 were allowed to bear against lower flange 130.

Still referring to FIGS. 3 and 6–8, joint assembly 30 further includes a spring member in the form of torsion spring 142 disposed within the cavity formed by upper and lower sockets 118 and 134, respectively, to engage loosely around stud flanges 128. As most clearly depicted in FIG. 8, spring 142 includes a straight upper end member 144 extending tangentially to the coils of the spring to extend through a slot 146 formed transversely through the vertical side wall of upper socket 118 at an elevation above upper flange 114. Spring upper end member 144 extends a distance through slot 146 to terminate at a location radially outwardly of the vertical side wall of upper socket 118 to thereby prevent the spring from becoming accidentially disengaged from the slot. Likewise, torsion spring 142 includes a straight, lower end member 148 which extends tangentially to the coils of the spring in a direction opposite to upper end member 144. Lower end member 148 also extends through a slot 150 formed transversely through the vertical wall of lower socket 134 in a direction opposite to slot 146. Moreover, end member 148 extends through slot 150 a distance beyond the outside diameter of lower socket 134 to thereby prevent spring 142 from accidentally decoupling from lower body member 28. Slots 146 and 150 are angularly located about stud 120 so that when spring 142 is in its nominal condition, upper body member 26 is angularly aligned with lower body member 28 in the manner shown in FIG. 1. The coils composing torsion spring 142 are wound so that when upper body member 26 is rotated rearwardly, clockwise in FIG. 1, the spring is further wound or energized. After being rotated rearwardly from its nominal orientation and then released, spring 42 unwinds to rotate upper body member 26 forwardly, in the counterclockwise direction of FIG. 1, to swing club 24 into ball 22.

Figure 7:
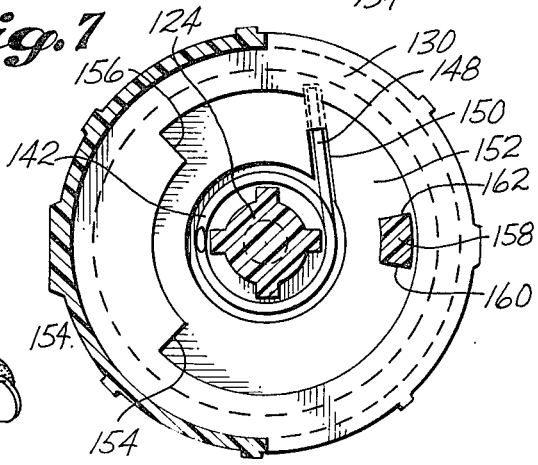
FIG. 7 is a cross-sectional view of the portion of the typical golfing figure illustrated in FIG. 6, taken substantially along lines 7—7 thereof, and specifically showing the configuration of the lower body member socket.

The angle which upper body member 26 is permitted to rotate is limited to approximately the angle of rotation which the upper body of an actual golfer typically sweeps when hitting a golf ball. This is accomplished by forming a shallow groove 152 within lower flange 130 around approximately three quarters of the circumference of lower socket 134. For ease of construction, groove 152, in the radially inwardly direction, breaks into the center of lower socket 134. Groove 152 terminates at vertical end walls 154 and 156 which extend upwardly from the bottom of groove 152 to the upper surface of flange 130. Groove 152 is formed deep enough to clear the lower surface of a lug 158 which extends downwardly from the lower surface of upper flange 114. As best shown in FIGS. 6 and 7, lug 158 is generally trapezoidal in transverse or horizontal cross section and is radially located relative to stud 120 to sweep through groove 152 when upper body member 26 is rotated relative to lower body member 28. If upper body member 26 is rotated rearwardly far enough, a side wall 160 of lug 158 will abut flatly against groove end wall 154 to thereby limit the rotation of upper body member 26. Correspondingly, if upper body member 26 rotates too far forwardly, the other side wall 162 of lug 158 abuts squarely against groove end wall 156 to thereby limit the forward rotation of the upper body member. In addition to limiting the rotation of upper body member 26 to correspond to the body rotation of an actual golfer, lug 158 also prevents spring 148 from being overstressed by being wound too tightly when upper body member 26 is rotated rearwardly or from being excessively unwound during rotation of upper body member 26 forwardly of its nominal location.

Golfing figure 20 is assembled preferably by first attaching arms 64 to chest front half 48 by engaging studs 66 through holes 68 formed in depressions 62 and then deforming the free ends of the studs to prevent them from sliding out through the holes. Next, joiner member 40 is engaged within head 36 and then the front and rear chest halves 48 and 50 are assembled together to retain joiner base 42 within neck operning 56 formed by the two chest halves. Thereafter, spring 142 is attached to the upper and lower body members 26 and 28, respectively, by engaging spring upper end member 144 within upper socket slot 146 and spring lower end member 148 within lower socket slot 150 while simultaneously engaging stud 120 within pilot hole 136. Next, snap ring 140 is pressed over stud free end 126 to lock the free end of stud 120 within pilot hole 136. Once spring 142 is engaged with slots 146 and 150, the spring prevents upper body member 26 from disengaging from lower body member 28, even if snap ring is not secured to stud 120, thereby facilitating the assembly of upper and lower body members 26 and 28. Lastly leg rear half 84 is assembled with leg front half 82 to retain feet assembly 80 between the lower end portions of the two leg halves. Leg rear half 84 can be secured to front leg half 82 by any convenient means, such as by chemically bonding or ultraxonically welding.

In operation, golfing figure 20 is typically used in conjunction with a playing surface, not shown, which resembles a typical hole and green of a golf course. The golfing figure is used to hit miniature golf ball 22 from a starting point to a hole using various types of clubs in the same manner in which an actual golfer plays golf. A golf club, such as iron 24, is attached to golfing figure 20 by sliding handle 74 longitudinally into hand opening 72 and then twisting the club so that blade 76 locks within notch 75. It will be appreciated that once club 24 has been attached to hands 70 in this manner, the club will be securely held in place even if upper body member 26 is rotated very rapidly. Next, golfing figure 20 is placed beside ball 22 in the same position in which an actual golfer would stand relative to a golf ball. The lower body member 28 is held stationary by placing the user's fingers over end plates 112 of feet assembly 80, as shown in FIG. 1. The upper body member 26 is then rotated rearwardly, in the clockwise direction in FIG. 1, by, for instance, hooking the user's finger over the arms or hands of the golfing figure. This rearward rotation of upper body member 26 simulates the swing of an actual golfer. Next, upper body member 26 is released causing it to rotate rapidly forwardly, in the counterclockwise direction shown in FIG. 1, to hit ball 22 with club 24 in the manner similar to which an actual golfer strikes a golf ball. The construction of golfing figure 20 allows upper body member 28 to swing forwwardly after hitting ball 22 to simulate the way which an actual golfer follows through after hitting a golf ball. It is apparent that the motion of golfing figure 20 closely correponds to the movement of an actual golfer's body when hitting a golf ball, and thus, the golfing figure can be used to illustrate proper golfing technique.

Not only can golfing figure 20 be utilized to illustrate an ideal golf stance and swing to hit a ball in a straight line, but also the golfing figure can be selctively positioned relative the ball and the club head angle adjusted to enable various other types of golf shots to be hit. For instance, a slice shot can be made by turning lower body member 28 slightly counterclockwise from its position shown in FIGS. 1 and 2 and rotating the face of the club so that it is tilted further rearwardly to achieve a more "open" club face. With these adjustments, golfing figure 20 will cause ball 22 to curve to the right when struck by club 24 to hit an intentional "slice" shot to, for instance, drive the ball around a tree or other obstacle.

It will be appreciated that the construction of hands 70 and club 24 enables the head of the golf club to be adjusted in response to the type of shot desired to be hit while still ensuring that the club does not rotate on impact with ball 22 nor disengage from bore 72. Moreover, constructing joint assembly 30 with lug 158 and groove 152 limits the rotation of upper body member 26 to closely correspond to the actual swing of a golfer. Restricting the movement of upper body member 26 also limits the rotation of torsion spring 142 to prevent it from being overstressed.

As will be apparent to those skilled in the art to which this invention is addressed, the present invention may be embodied in specific forms and embodiments other than those specifically here described without departing from the spirit or essential characteristics of the invention. The particular embodiments of golfing figure 20, described above, are therefore to be considered in all respects as illustrative and not restrictive. The scope of the present invention is set forth in the appended claims rather than being limited to the examples of golfing figure 20 described in the foregoing description.

What is claimed is:

1. In a golfing figure shaped to resemble a human golfer holding a golf club with outstretched arms and bent forwardly to address a golf ball, the figure having an upper body member forming the portion of the golfing figure from the waist up and a lower body member forming the portion of the golfing figure from the waist down, an improved joint assembly interconnecting the upper and lower body members for relative rotation about an axis extending generally along the length of the upper body member, said improved joint assembly comprising:

(a) a downwardly open, upper socket formed in the lower portion of the upper body member;

(b) a pin extending downwardly through said upper socket along the axis of rotation of the upper body member;

(c) an upwardly open, lower socket formed in the upper portion of the lower body, said socket having portions defining a pilot hole for rotatably receiving the lower end portion of said pin;

(d) spring means surrounding said pin and housed within said upper and lower sockets;

(e) attaching means for attaching said spring means to the upper and lower body members so that the upper and lower body members are nominally aligned with each other; and (f) stop means for limiting the angle of relative rotation of the upper and lower body members between a first position wherein the upper body member is rotated rearwardly from angular alignment with the lower body member to thereby energize said spring means, and a second position wherein the upper body member is rotated forwardly from angular alignment with the lower body member to thereby release said spring means.

2. The improvement according to claim 1, wherein the upper body member includes a head assembly and a hollow chest assembly having a front chest half and a rear chest half, said front and rear chest halves including portions which cooperatively define a neck opening for receiving said head assembly.

3. The improvement according to claim 2, wherein said upper socket is integrally formed with either the front or rear shell half of said upper body member.

4. The improvement according to claim 3, wherein said head assembly includes:

a hollow head having an opening in its lower portion corresponding to the location of the neck; and joiner means for interconnecting said head with said upper body member, said joiner means having a plug portion snugly receivable within said head opening and an integral base portion snugly receivable within said neck opening.

5. The improvement according to claim 1, wherein the lower body member includes a feet assembly, a hollow lower body portion having a front shell half and a rear shell half, and means for securing said feet assembly to said lower body portion.

6. The improvement according to claim 5, wherein said lower socket is integrally formed with either said front or rear shell half of said lower body portion.

7. The improvement according to claim 5, wherein said feet assembly includes a pair of feet, a base plate interconnecting the feet and extending laterally of each side of the feet.

8. The improvement according to claim 1, wherein the upper body member includes a flat upper thrust flange surrounding said upper socket, and the lower body member includes a flat lower thrust flange surrounding said lower socket, said two upper and lower thrust flanges disposed in face-to-face contact with each other to rotate relative to each other when the upper body member rotates relative to the lower body member.

9. The improvement according to claim 8, wherein:

said spring means includes a torsion spring having straight end members extending tangentially outwardly from the spring coils at each end of said spring; and, said attaching means includes an upper slot extending transversely through said upper socket at an elevation above said upper thrust flange for receiving one of said spring end members therein, and a lower slot extending transversely through said lower socket at an elevation below said lower thrust flange for receiving said other spring end member therein.

10. The improvement according to claim 1, wherein said stop means includes a lug member extending downwardly from the upper body member, and an arcuate groove formed in the upper end portion of the lower body member to extend partially around said pilot hole for receiving said lug, said groove having end walls abuttable against said lug for limiting the forward and rearward rotation of the upper body member relative to the lower body member.

11. The improvement according to claim 1, wherein:

the hands of the golfing figure are clasped together and includes portions defining an opening for slidably receiving the handle portion of a golf club; and further comprising means for locking the golf club to the hands of the golfing figure including a blade member partially encircling the handle of the golf club and an arcuate notch formed in the hands of the golfer to snugly receive said blade upon rotation of the golf club once the club handle is engaged with said opening formed in the hands.

* * * * *